United States Patent [19]

Drane

[11] Patent Number: 4,875,146

[45] Date of Patent: Oct. 17, 1989

[54] FLASHLIGHT BULB MOUNTING

[75] Inventor: John H. Drane, London, United Kingdom

[73] Assignee: Duracell Inc., Bethel, Conn.

[21] Appl. No.: 60,244

[22] PCT Filed: Aug. 20, 1986

[86] PCT No.: PCT/US86/01732

§ 371 Date: May 19, 1987

§ 102(e) Date: May 19, 1987

[87] PCT Pub. No.: WO87/01175

PCT Pub. Date: Feb. 26, 1987

[30] Foreign Application Priority Data

Aug. 21, 1985 [GB] United Kingdom ..... 8520960

[51] Int. Cl.[4] ..... F21L 7/00

[52] U.S. Cl. ..... 362/202; 362/208; 362/204; 362/390; 200/60

[58] Field of Search ..... 362/157, 186, 187, 200, 362/202, 204, 208, 205, 390; 200/60

[56] References Cited

U.S. PATENT DOCUMENTS

| | | | |
|---|---|---|---|
| 1,403,538 | 1/1922 | Burgess | 362/187 |
| 1,591,627 | 7/1926 | Hopkins | 362/208 |
| 2,287,505 | 6/1942 | Wood | 362/202 |
| 2,651,763 | 9/1953 | Grimsley | 362/157 |
| 3,076,891 | 2/1963 | Moore | 200/60 |
| 3,898,450 | 8/1975 | Kilby | 200/60 |
| 4,041,304 | 8/1977 | Spector | 200/60 |
| 4,286,311 | 8/1981 | Maglica | 200/60 |
| 4,734,834 | 3/1988 | Petzl et al. | 200/60 |
| 4,737,892 | 4/1988 | Ohashi | 200/60 |

FOREIGN PATENT DOCUMENTS

| | | | |
|---|---|---|---|
| 1044869 | 10/1966 | United Kingdom | 362/157 |
| 3343913 | 6/1984 | Fed. Rep. of Germany | 362/157 |
| 2161024 | 1/1986 | Japan | 362/202 |
| 562689 | 7/1944 | United Kingdom | 362/204 |
| 812980 | 5/1959 | United Kingdom | 362/202 |

*Primary Examiner*—Ira S. Lazarus
*Assistant Examiner*—D. M. Cox
*Attorney, Agent, or Firm*—Ronald S. Cornell; James B. McVeigh

[57] ABSTRACT

A hand torch has a bulb holder 8 of molded plastics material, designed to protect the bulb 19 from damage due to movement of the batteries 14 if the torch is dropped. The bulb holder has an outer wall 9, inner wall 10, forward flange 11 within which is a bulb-holding recess, and radial ribs 12 against which the forward rim 13 of the battery abuts when the battery contact pip 17 touches the bulb center contact spring 16. The ribs 12 are abutments preventing the battery from moving towards the bulb if the torch is dropped. The lens 4 is made of ORAGLASS DR toughened acrylic material.

2 Claims, 2 Drawing Sheets

FLASHLIGHT BULB MOUNTING

This invention relates to hand torches and the like.

A typical construction for a hand torch comprises a tubular barrel or body and a detachable head or cap which incorporates or retains a lens, reflector and bulb holder. One or more cylindrical batteries are contained in the body, and the uppermost battery makes contact with its central contact pip, on the contact stud of the bulb or on a metal contact of a bulb holder immediately at the rear of the bulb contact stud. The bulb is positively located in the direction towards the front end of the torch, to locate it accurately relative to the reflector so as to provide a focus beam.

In conventional torches, bulbs are often damaged and made inoperative, by the torch being dropped. Dropping the torch tends to cause the battery or batteries to shift abruptly along the torch body, and the resulting impact on the rear end of the torch bulb (particularly in the case of the larger batteries and multi-battery torches) is often sufficient to make the bulb inoperative, even if a bulb holder contact is present between the battery pip and the bulb contact stud. Even if the torch is dropped in such a way as to tend to move the batteries away from the bulb, the bulb is still commonly damaged, because the contact spring provided at the rear end of the torch body reverses the direction of movement of the batteries relative to the body and bulb.

A hand torch is known, in which a shock absorber-/abutment is provided as an additional component seated behind the reflector and surrounding the bulb holder, to limit forwards movement of the batteries towards the bulb holder. This construction is expensive and difficult to assemble, both in manufacture and when the user opens the torch to change batteries or bulbs, because the shock absorber-abutment is a separate loose component which has to be located accurately in position and angular orientation when the torch is assembled or reassembled.

According to one aspect of the present invention, a torch or the like is provided with a bulb holder, and an abutment/shock absorber integral with the bulb holder, for limiting movement of the battery or batteries towards the bulb holder and for absorbing and/or diverting away from the bulb the kinetic energy of any such movement.

Preferably, the shock absorber/abutment is an annular body of plastics material around the bulb holder proper, against which the forward and rim of the battery or the foremost battery abuts in normal conditions.

Preferably, a central contact is provided in the bulb holder, having a forward portion which makes contact with the contact stud of a bulb when seated in the holder, and a rear portion which makes contact with the central contact tab of the battery when the rim of the latter abuts on the shock absorber/abutment.

By making the shock absorber/abutment integral with the bulb holder, we ensure that it is always correctly placed in the torch when the torch is assembled or reassembled. Production cost is significantly reduced and convenience in use is enhanced. Furthermore, the preferred form of shock absorber/abutment, to be described hereinafter, provides enhanced protection for the bulb, compared with the previous construction described above.

According to another aspect of the present invention, a lens of a torch, hand lantern or the like is made of a toughened acrylic material, in particular that known under the trade name OROGLASS DR, manufactured by Rohm and Haas.

Compared with existing materials used for such lenses, this material has excellent clarity, vastly improved strength and toughness against impact, and it can be welded to plastics materials commonly used for torch and lantern manufacture such as ABS and polystyrene.

A hand torch embodying the present invention is illustrated by the accompanying drawings, in which.

Figure 1:
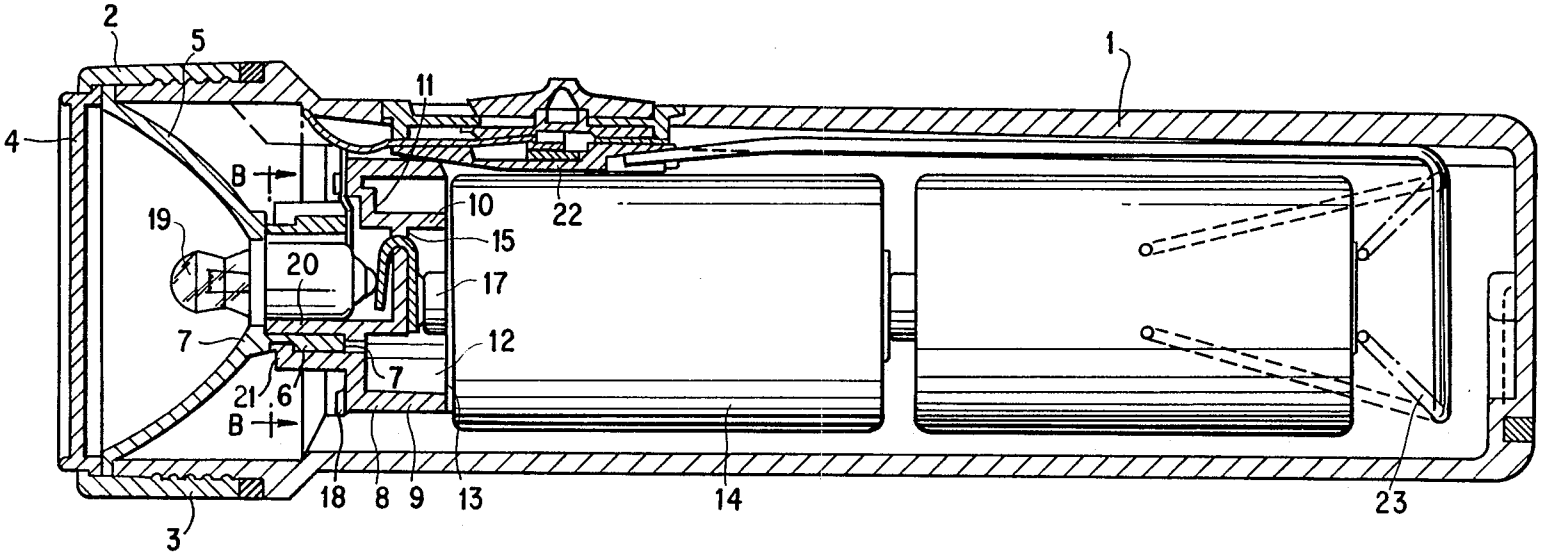
FIG. 1 is a longitudinal cross section of a hand torch embodying the invention.
Figure 2:
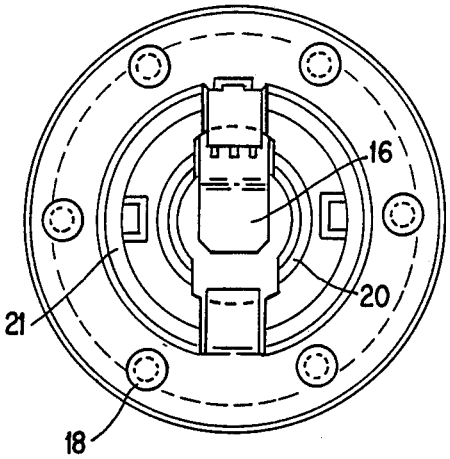
FIG. 2 is a section through the torch on the line B—B of FIG. 1 showing a lens holder and shock absorber unit.
Figure 3:
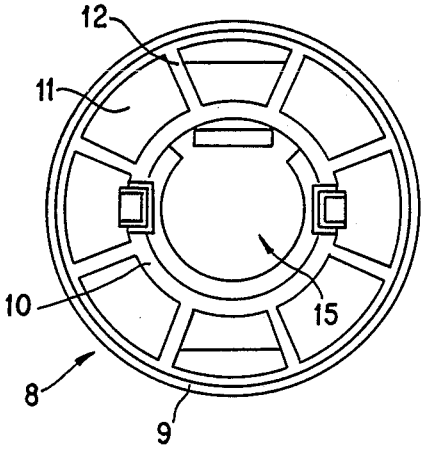
FIG. 3 is a rear view of the lens holder and shock absorber unit.

The illustrated torch has a tubular body of molded ABS material, with the conventional contact spring 23 in its rear end and any suitable contact and switch mechanism. The body is designed to accommodate two or three conventional cells for example of DURACELL (Registered Trademark) MN 1300 size.

The torch also has a head assembly 2 mounted detachably, for example by screwthreads on the body 1. Any suitable head construction can be used, the illustrated torch has a head comprising a cap 3 of molded ABS, a lens 4 (which may be flat or of any desired shape) seated in the cap, and a reflector 5 of metal or metallized plastic such as metallized polystyrene, seated in the cap behind the lens. The rims of the reflector, lens and cap are united for example by sonic welding, solvent welding, adhesives or otherwise, to form a unitary head assembly.

At its rear, the reflector has a neck 6 provided with an abutment 7 for locating the flange of a conventional pre-focus bulb 19 so that the bulb filament is correctly placed relative to the reflector.

The lens is made of a toughened acrylic material marketed under the trade name OROGLASS DR. This material has properties of toughness and clarity which are superior to those of polycarbonate materials used at present where toughness is required, is relatively cheap, and can be bonded for example by sonic welding to ABS materials.

Behind the reflector is a lens holder unit 8 of moulded ABS or acetal material. This comprises a cylindrical outer wall 9, an inner wall 10, a flange 11 extending between these and radial ribs 12 integral with the flange and the inner and outer walls. The ribs form abutment surfaces against which rests the rim 13 of the foremost battery 14. A central recess within the inner wall 10 has in its base 15 a U or V-shaped leaf spring contact 16, of which the forward limb contacts the rear contact stud of the bulb, and the rear limb makes contact with the contact pip 17 of the battery 14 when the battery rests against the ribs 12. In this position, the pip 17 and the rear limb of the contact spring are clear of the base of the recess.

The forward side of the central region of the unit 8, within the inner wall 10, has a projecting collar 20 that locates the rear end of the bulb so that the bulb locating flange is held against the locating abutment 7.

The unit 8 incorporating the bulb holder is attached to the rear of the reflector in any convenient way, for example by a push fit, bayonet lock ring 21 or screwthreads. The unit 8 may be loose relative to the head assembly 2, but we prefer to provide means for attaching it separably to the head, for ease of assembly and dismantling, and to ensure accurate location of the bulb in the reflector.

In normal use, the contact spring at the rear of the body holds the foremost battery 14 against the ribs 12 of the lens holder unit 8, and the battery pip 17 in contact with the rear limb of the contact 16, the latter remaining clear of the bottom of the recess 15. Energisation of the bulb is controlled by any suitable switch 22 making and breaking a circuit from the contact spring at the rear of the body, to the body shell of the bulb through a contact ring 18 heat-staked to the front of the flange 11.

If the torch is dropped, the batteries cannot move towards the bulb holder and bulb because the foremost battery is already in contact with the abutment ribs 12. The batteries may initially move backwards against the contact spring, which will then reverse the movement and throw the batteries forward, however in this case also their movement is limited by the abutment ribs 12. The energy of the impact is therefore transmitted directly to the plastics unit 8, which absorbs part of the energy internally and transmits the remainder to the torch head assembly. None of the impact energy of the batteries can reach the bulb because it is all absorbed or diverted by the unit 8 and in particular the battery pip 17 is always held clear of the base of the recess 15 behind the bulb. Damage to the bulb by dropping the torch is therefore substantially eliminated.

Since the unit 8 integrally incorporates both the shock-absorbing and diverting means and the bulb holder proper, and can be a simple injection moulded component in the illustrated embodiment, its manufacture is simpler and cheaper than the manufacture of a shock absorbing component and a separate conventional bulb holder. Assembly of the torch is also greatly simplified on manufacture, as is dismantling and reassembly of the torch by a user to change the bulb or batteries.

In the illustrated embodiment the unit 8 operates to divert impact energy to the head of the torch. Alternatively, the unit 8 could be arranged to divert the energy directly into the torch body. For example, the torch body may be openable at its rear end for changing batteries, the unit 8 and bulb being inserted through the open rear end into register with the reflector but in contact with an internal abutment of the body. Alternatively, in a torch with a removable head, the unit 8 may have an interrupted periphery which can be inserted behind an interrupted internal flange of the body in the open front body end, by being inserted in the body and then rotated to bring its projecting peripheral region behind the body flange, before the head is fitted to the body. However, it is believed to be particularly convenient to have the unit 8 transmit the impact energy to the torch head assembly as this provides a very simple and effective construction.

What is claimed is:

1. A portable lamp comprising a lamp body, a bulb holder in the lamp body, a battery space adjacent the bulb holder for containing at least one battery cell, and means for limiting relative movement of the battery cell towards the bulb holder, characterized in that the bulb holder is a body of plastic material which includes the said movement limiting means as an integral part thereof, with said bulb holder and the integral, movement limiting means comprising inner and outer annular walls, a flange integral with and extending radially between a forward portion of the outer annular wall and the inner annular wall, and radial ribs extending rearwardly of the said flange and being integral with said flange and with the said outer annular wall, and the said movement limiting means extending axially beyond the central contact pip of the bulb, whereby said movement limiting means is adapted to be contacted by the adjacent battery cell upon any axial forward movement thereof to divert shock away from said central contact pip of the bulb.

2. A portable lamp comprising a lamp body, a reflector, a bulb holder in the lamp body and discrete from said reflector, a battery space adjacent the bulb holder for containing at least one battery cell, and means for limiting relative movement of the battery cell towards the bulb holder, characterized in that the said movement limiting means is an annular body around the bulb holder proper and said movement limiting means and said bulb holder consists of an integral molding of plastic material, and the forward end rim of the battery cell or foremeost battery cell abuts said annular body in normal conditions, and in which the said annular body comprises an annular outer wall for locating the said body and bulb holder laterally in the lamp body.

* * * * *